US006532346B2

(12) United States Patent
Gallivan

(10) Patent No.: US 6,532,346 B2
(45) Date of Patent: Mar. 11, 2003

(54) SYSTEMS AND METHODS FOR PRINTING SHIPPING LABELS FOR RECYCLING PRINTING DEVICE REPLACEABLE COMPONENTS

(75) Inventor: Susanne M. Gallivan, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/921,879

(22) Filed: Aug. 2, 2001

(65) Prior Publication Data

US 2003/0026620 A1 Feb. 6, 2003

(51) Int. Cl.[7] ..... G03G 15/00
(52) U.S. Cl. ..... 399/12; 399/24
(58) Field of Search ..... 399/11, 12, 24, 399/25, 26, 27, 411; 358/1.14

(56) References Cited

U.S. PATENT DOCUMENTS 5,506,943 A * 4/1996 Furukawa ..... 358/1.14
5,521,710 A * 5/1996 Strossman et al. ..... 358/296
5,758,224 A * 5/1998 Binder et al. ..... 399/25
5,930,553 A * 7/1999 Hirst et al. ..... 399/12
6,285,835 B1 * 9/2001 Guillemin et al. ..... 399/12
6,321,983 B1 * 11/2001 Katayanagi et al. ..... 235/375
6,332,062 B1 * 12/2001 Phillips et al. ..... 399/12

FOREIGN PATENT DOCUMENTS

DE 10040456 A * 3/2001 ..... G03G/21/18
JP 58072146 A * 4/1983 ..... G03G/05/00
JP 07092758 A * 4/1995 ..... G03G/15/00

* cited by examiner

*Primary Examiner*—Robert Beatty

(57) ABSTRACT

Systems and methods are described for printing shipping labels for recycling printing device replaceable components. When a printing device detects an end-of-life condition of a replaceable component in the printing device, a printing device user is prompted to enter information identifying the user and/or the location of the printing device (possibly after accessing a web site). Alternatively, this information may be stored in component memory of a replaceable component where it is obtained by the printing device automatically. An appropriate recycling location is determined from the geographic location of the printer and a shipping label including the address of the recycling location is printed from the printing device.

17 Claims, 3 Drawing Sheets

200

SYSTEMS AND METHODS FOR PRINTING SHIPPING LABELS FOR RECYCLING PRINTING DEVICE REPLACEABLE COMPONENTS

TECHNICAL FIELD

This invention generally relates to recycling depleted consumables for printing devices and, more particularly, to printing return shipping labels for use in recycling printing device replaceable components.

BACKGROUND

Most types of printing devices are equipped with replaceable components that have a life cycle during which the replaceable components are functional. At the end of the life cycle of a replaceable component, the component must be replaced for the printing device to continue to function properly. Materials and instructions for returning and/or recycling the used replaceable component are typically included with the new replaceable component.

For example, a print cartridge is installed in a laser printer to provide toner for the printing process. As documents are printed, the toner supply is gradually depleted. When the toner supply is exhausted, the printer cannot print any further documents until the print cartridge is replaced. An owner/user of the printer must now purchase a replacement print cartridge for the printer and may choose to recycle the depleted print cartridge. Typically, the user will use a box in which the new component was packaged to pack the old component. A shipping label contained in the new component packaging may then be affixed to the box to return the old component.

There are some disadvantages to this type of system. One problem is that the box for the new replaceable component may be opened long before the new component is installed in the printer and, as a result, the shipping label is lost before the time to use it arrives.

Also, some print cartridge manufacturers and/or recyclers have more than one location to recycle used components. If so, they may want to have replaceable components from a certain geographical area returned to a certain recycling center. Although a vendor may insert different shipping labels in different component packages depending on where the component is sold, the vendor cannot guarantee an appropriate distribution of components when they are returned for recycling. Additionally, such a method is unduly burdensome on the vendor and becomes more trouble than it is worth.

There are also problems of users returning components of one brand to a manufacturer/recycler of components of another brand. For instance, if a user replaces a generic print cartridge with a genuine Hewlett-Packard print cartridge, then the user will have shipping materials to return the Hewlett-Packard print cartridge for recycling. If the user returns the generic cartridge to a Hewlett-Packard recycler, then the HP recycler may not be able to process the cartridge and, as a result, time and money are wasted.

SUMMARY

Systems and methods are described herein for printing shipping labels for recycling printing device replaceable components.

When a printing device replaceable component is at or nearing the end of its functional life, a signal is typically generated by the printing device indicating that the replaceable component either needs to be replaced immediately or will need to be replaced in the near future. When the printing device detects the end-of-life condition of a replaceable component, certain information is obtained from the user. This is done in several ways. For example, the user may be prompted to access a web site, where the user enters the information; the user may be prompted to enter the information directly into the printing device or via a host computer connected to the printing device; the information may be automatically obtained from component memory integrated into the replaceable component; a web site address may be retrieved from component memory and accessed, etc. The information may be about the printing device (if components of certain printing devices are to be returned to certain recycling locations), or the user's location (if component recycling locations are determined by geography), etc.

When the user accesses the web site (or after the information has been alternatively entered), information may be displayed to the user. This information could be an advertisement, recycling instructions, product information, etc.

The label may be printed before replacing the component or after replacing the component. This depends on whether or not the printing device is able to print after the signal to replace the component is received. For instance, if a fuser fails and thus renders the printing device non-operational, then the shipping label will necessarily be printed after a new fuser is installed.

In another circumstance, a low toner signal may be received. Since the printing device may function with the same toner cartridge for some time, a user may defer printing the label until the time when the user is actually prepared to replace the toner cartridge.

In one implementation, a fuser is prompted to insert special printing media—such as labels—into the printing device to facilitate printing of the shipping label. Otherwise, the shipping label may be printed on plain paper and inserted into an adhesive pouch for affixing to the shipping container or taped to the shipping container, etc., for shipping.

Advantages realized by the systems and methods described herein include encouraging proper recycling of printing device replaceable components, eliminating waste associated with unused labels, saving the cost of pre-printed paper labels and discouraging users from returning replaceable components from one manufacturer to recycling centers of another manufacturer. In addition, vendors having several recycling locations can more evenly distribute replaceable components returned for recycling based on the geographic location of users or based on other user or product data. The systems and methods described herein also provide a replaceable component vendor with an opportunity to display a consumer or advertising message to users when the users access the recycling program. Finally, if a replaceable component that is returned for recycling includes component memory integrated therewith, data of specific interest to the vendor can be retrieved from the memory during the recycling process. For instance, a vendor can determine where the component was used rather than where it was obtained, etc.

BRIEF DESCRIPTION OF THE DRAWINGS

The present invention is illustrated by way of example and not limitation in the figures of the accompanying drawings. The same numbers are used throughout the figures to reference like components and/or features.

DETAILED DESCRIPTION

Figure 1:
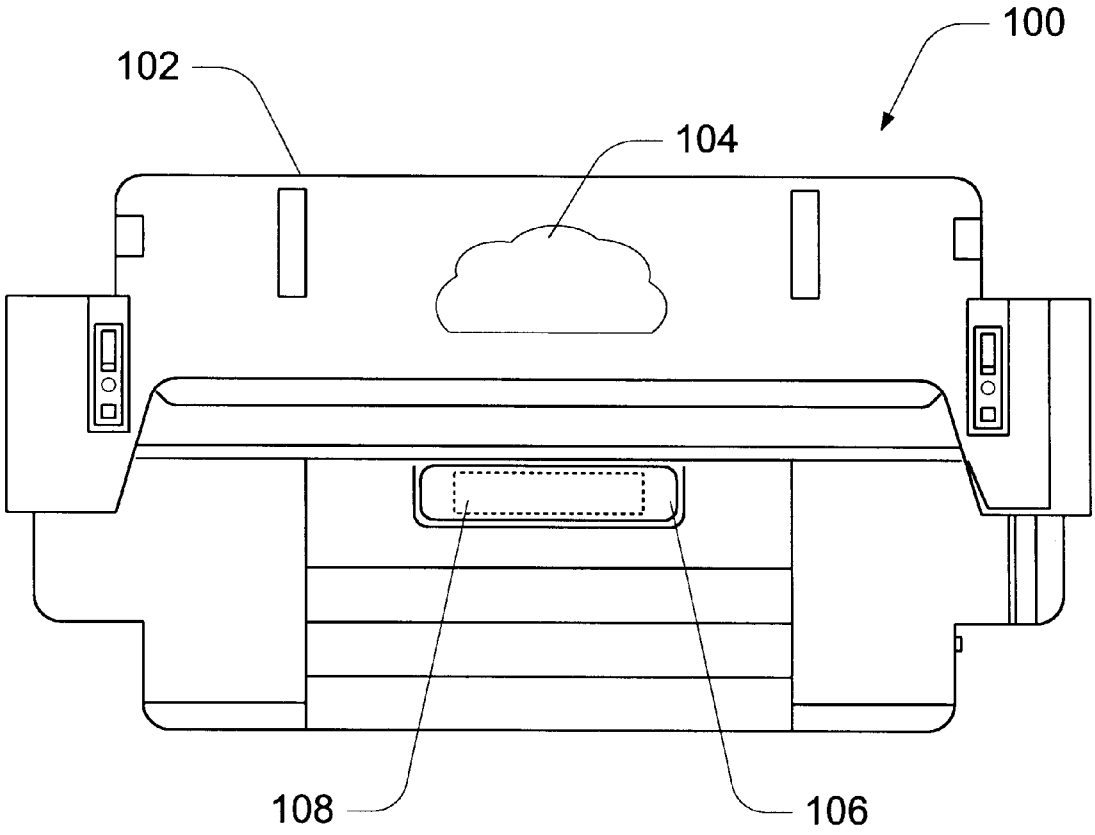
FIG. 1 is an illustration of a laser printer toner cartridge that includes cartridge memory integrated therewith.

The following description sets forth one or more specific implementations and/or embodiments of systems and methods for printing return shipping labels for recycling used replaceable components for printing devices. The systems and methods incorporate elements recited in the appended claims. These implementations are described with specificity in order to meet statutory written description, enablement, and best-mode requirements. However, the description itself is not intended to limit the scope of this patent.

Also described herein are one or more exemplary implementations of systems and methods for printing return shipping labels for use in recycling used replaceable components for printing devices. Applicant intends these exemplary implementations to be examples only. Applicant does not intend these exemplary implementations to limit the scope of the claimed present invention(s). Rather, Applicant has contemplated that the claimed present invention(s) might also be embodied and implemented in other ways, in conjunction with other present or future technologies.

Computer-Executable Instructions

An implementation of a system and/or method for printing shipping labels for use in recycling used replaceable components for printing devices may be described in the general context of computer-executable instructions, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Computer-Readable Media

An implementation of a system and/or method for printing shipping labels for recycling used replaceable components for printing devices may be stored on or transmitted across some form of computer-readable media. Computer-readable media can be any available media that can be accessed by a computer. By way of example, and not limitation, computer readable media may comprise "computer storage media" and "communications media."

"Computer storage media" include volatile and non-volatile, removable and non-removable media implemented in any method or technology for storage of information such as computer readable instructions, data structures, program modules, or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

"Communications media" typically embodies computer-readable instructions, data structures, program modules, or other data in a modulated data signal, such as carrier wave or other transport mechanism. Communication media also includes any information delivery media.

Exemplary Printing Device Replaceable Component

Figure 2:
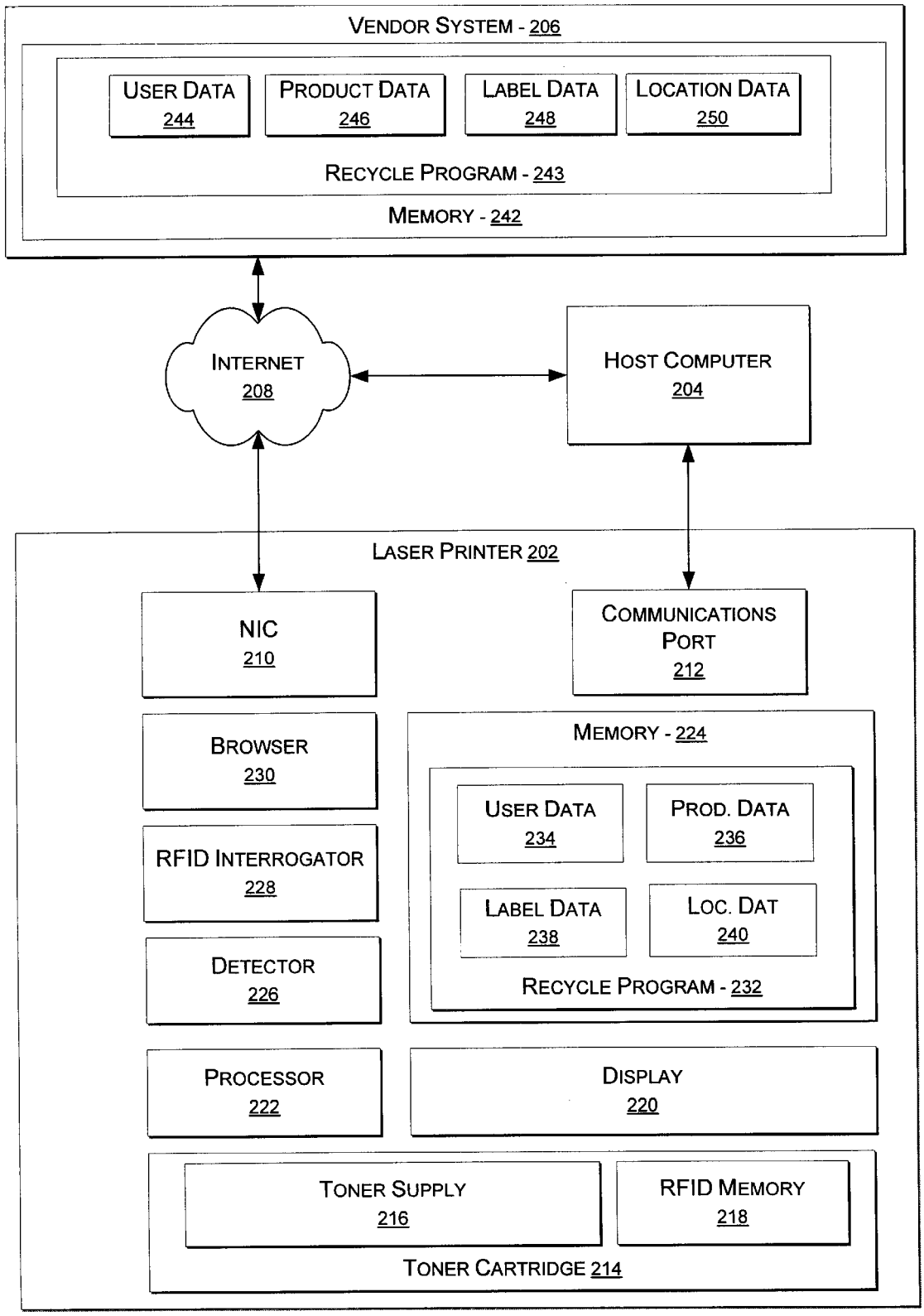
FIG. 2 is a block diagram of an exemplary shipping label printing system for printing a recycling/return shipping label.

FIG. 1 is an illustration of a toner cartridge 100 that is installable in a laser printer (as shown in FIG. 2) and is suitable for use in the recycling shipping label printing system described herein. Although the invention shown and described herein utilizes a printer toner cartridge for a laser printer, it is noted that the invention may be utilized with any replaceable component (toner cartridge, ink cartridge, print cartridge, imager drum, fuser, etc.) installable in a printing device (printer, copier, fax machine, etc.). The toner cartridge 100 includes a cartridge body 102 that contains a toner supply 104.

A memory tag 106 is located underneath a label 108 on the toner cartridge 100, although the memory tag 106 may be placed on the toner cartridge 100 at any location which may be practical for the purposes described herein. The memory tag 106 is preferably a radio frequency identification (RFID) memory tag. RFID memory tags and applications therefor are well known in the art. Further aspects of the functionality of the RFID memory tag 106 in the present invention(s) will become clearer as the discussion progresses. It is noted that, although the toner cartridge 100 is shown as having component memory integrated therewith, those skilled in the art will recognize that the present invention(s) may be implemented with replaceable components that do not include component memory. For example, a web site could be listed on the packaging that, when accessed by the user, would provide a return shipping label printing program.

Exemplary Recycling Shipping Label Printing System

FIG. 2 is a block diagram of an exemplary recycling shipping label printing system 200 constructed in accordance with the invention(s) described herein. The system 200 includes a laser printer 202 that is connected to a host computer 204 and communicates with a vendor system 206 via the Internet 208. Although the present discussion focuses on a system having a laser printer, it is noted that the recycling shipping label system described herein may be utilized with any type of printing device—such as an inkjet printer, a facsimile machine, a copy machine, etc.—that uses replaceable components. It will be recognized by those skilled in the art that many of the features shown in the laser printer 202 and/or the functions performed by those features may be implemented as software modules, hardware devices and/or a combination thereof The laser printer 200 also includes a network interface card 210 and a communications port 212. The network interface card ("NIC") 210 is configured to access and communicate with the vendor system 206 via the Internet 208. The communications port 212 is a parallel port through which the laser printer 202 communicates with the host computer 204, although it could be any port to which the host computer 204 may be connected.

The laser printer 202 also includes a replaceable toner cartridge 214 that has a toner supply 216 stored therein. The toner cartridge 214 also includes an RFID memory tag 218 integrated therewith, though any type of memory known in the art for integration with a printing device replaceable component may be used. Although the present discussion will focus on the replacement of the toner cartridge 214, it is noted that the invention described herein is suitable for use related to any replaceable component that is used in the laser printer 214.

The laser printer 202 further includes a display 220, a processor 222 and memory 224. A detector 226 is included that is configured to detect when a replaceable component in the laser :printer 202 is nearing or has reached the end of its functional life cycle. For the present discussion, the detector 226 is a low toner detector 226 that detects when the toner supply 216 of the toner cartridge 214 is nearing a depletion level that indicates that a replacement toner cartridge (not shown) should be obtained to replace the used toner cartridge 214. The detector 226 is shown located in the laser printer 202 itself, although the detector 226 may be integrated into the toner cartridge 214.

An RFID interrogator 228 is included in the laser printer 202. The RFID interrogator 228 reads from and, in some cases, writes to the RFID memory tag 218 located on the toner cartridge 214. A browser 230 is also included in the laser printer 202 to access a network, such as the Internet 208. It is noted that the browser 230 may comprise hardware, software or a combination of both. Also, the browser 230 may be configured to access other types of networks, such as local area networks (LAN), wide area networks (WAN), intranets, etc.

A recycle program 232 is stored in the memory 224 of the laser printer 202. The recycle program 232 includes a user data module 234, a product data module 236, a label data module 238 and a location data module 240. The user data module 234 contains user information that is entered by a laser printer 202 user. The product data module 236 contains information about the laser printer 202 itself and the components included in the laser printer 202. The label data module 238 contains printer code used to print a shipping label suitable for use in returning a replaceable component for recycling. The location data module 240 contains addresses and, possibly names, of locations where a depleted component may be sent for recycling. The location data module 240 also contains data that correlates data in the user data module 234 and/or data in the product data module 236 to recycling locations.

The vendor system 206 also includes memory 242 that stores a recycle program 243 that has a user data module 244, a product data module 246, a label data module 248 and a location data module 250. The recycle program 243 and the modules 244–250 stored in the memory 242 of the vendor system 206 are similar to the recycle program 232 and the modules 234–240 stored in the memory 232 of the laser printer 202. It will be seen as the discussion progresses, that either the modules 244–250 stored in the vendor system 206 or the modules 234–240 stored in the laser printer 202 may be used to implement the invention(s) described herein. It is not required that the vendor system 206 and the laser printer 202 both have the same modules. However, as described below in greater detail, it is preferable that the modules 244–250 be stored and utilized in the vendor system.

The features and functions of the laser printer 202 and the vendor system 206 and their components will be described in greater detail, below, with continuing reference to FIG. 2 as well as with reference to FIG. 3.

Methodological Implementation of the Recycle Shipping Label Printing System

Figure 3:
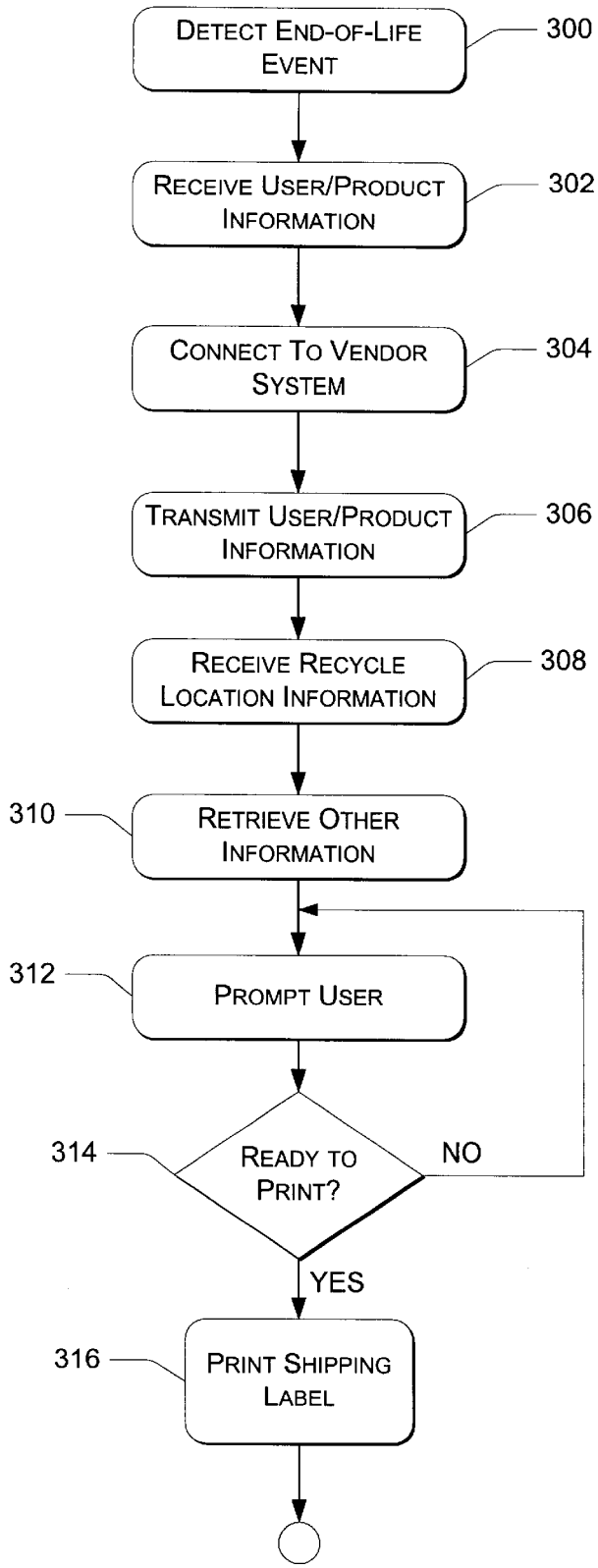
FIG. 3 is a flow diagram depicting a methodological implementation of a recycling shipping label printing process.

FIG. 3 is a flow diagram depicting a methodological implementation of the recycle shipping label printing system described herein. At block 300, the detector 226 detects a low toner situation with the toner cartridge 214 of the laser printer 202 that indicates that a replacement for the toner cartridge 214 will soon be required. For this specific example of a toner cartridge in a laser printer, this is typically in the form of a "low toner" signal. However, any printing device replaceable component may be used, if the replaceable component has a functional life cycle that may reach a state (such as nearing depletion, depleted, etc.) wherein the detector 226 determines that a replacement component is required or will soon be required.

It is also noted that, although the low toner signal is used as the end-of-life event for the replaceable component, i.e., the toner cartridge 214, in the present example, other end-of-life signals for the toner cartridge 214 and/or other replaceable components for the laser printer 202 could be utilized. One or more of these other end-of-life signals may come in a situation wherein the laser printer 202 can no longer print. For example, a fuser may reach an end-of-life condition that prevents the laser printer 202 from printing. In such a case, the implementation will differ slightly from that described herein, in that a new fuser must be installed in the laser printer 202 before the shipping label to return the old fuser can be printed. Those skilled in the art will recognize the necessary changes in the described process.

After the end-of-life event is detected at block 300, recycle program 232 accesses user and/or product information to aid in determining a preferred recycling location to which the depleted toner cartridge 214 should be shipped (block 302). This may be accomplished in a variety of ways.

In one implementation, the RFID interrogator 228 reads product data 236 from the RFID memory 218 of the toner cartridge 214 and sends the product data 236 to the recycle program 232. This may be the case in situations where a vendor determines a recycling location based on the product to be recycled. For instance, a toner cartridge may be sent to one location, while a photoconductive drum may be sent to another location.

In another implementation, the recycle program 232 prompts a user to enter user data 234. This information may be the user's name and address, which may then be printed as the return address on the shipping label, stored in the RFID memory 218 for retrieval during the recycling process, stored in the memory 224 of the laser printer 202, etc. The recycle program 232 may then utilize the user data 234 to locate an appropriate recycling location in the location data module 240. This implementation would be used in situations where a vendor sends replaceable components from certain geographical areas to particular recycling centers associated with the geographical areas. The recycle program 232 uses data obtained from the location data module 240 to determine shipping label data that is stored in the label data module 238 and used to print a return shipping label.

In the preferred implementation described in the flow diagram of FIG. 3, the recycle program 243 of the vendor system 206 obtains the user/product information. The RFID interrogator 228 of the laser printer 202 retrieves a web site address, i.e., a Universal Resource Locator (URL), which is stored in the RFID memory tag 218 of the toner cartridge 214. The recycle program 232 of the laser printer 202 accesses the URL with the browser 230 (block 304). The recycle program 243 of the vendor system 206 displays a prompt for the user to enter the user's name and address.

The user enters the user information and the user information is transmitted to the recycle program 243 at block 306. The user data 244 is compared to the location data 250 to determine an appropriate recycling location to which the toner cartridge 214 should be shipped. In this particular example, the user's address is used to identify a recycling location by geographical area that is nearest to the user's address. At block 308, the recycle location information is transmitted to the recycle program 232 of the laser printer 202. This information includes instructions for printing the shipping label. These printing instructions are derived from the label data module 248 and, after transmission to the laser printer 202, are stored in the label data module 238 of the recycle program 232 in the laser printer 202.

It is noted that the vendor system 206 may utilize the information received from the user in other ways as well. For example, the user information may be stored in the user data module 244 for later reference. Also, product information may be received with the user information, and the product information may be stored in the product data module 246 for later use.

At block 308, the laser printer 202 receives other information from the vendor system 206. This information may be an advertisement, consumer information, recycling instructions, etc. The other information may be displayed to the user on the display 220 of the laser printer 202, on a display (not shown) of the host computer 204, or it may be printed by the laser printer 202.

At block 312, the user is queried if the user is ready to print the recycling shipping label. This is desirable in this example because the end-of-life signal is a low toner signal from the toner cartridge 214. Several pages may be printed from the toner cartridge 214 after this signal occurs. Therefore, the user may not wish to replace the toner cartridge 214 right away, in which case the user would probably want to wait to print the shipping label.

If the user is ready to print the shipping label ("Yes" branch, block 314), then the shipping label is printed with the appropriate recycle location at block 316. If the user wishes to wait ("No" branch, block 314), then the user is prompted again at a later time, such as after ten additional pages have been printed (block 312). If special print media is desired to be installed in the laser printer 202 prior to printing the shipping label, then that is another condition checked at block 314. For example, if it is desirable to print the shipping label on special label print media, then the print job may wait until the label print media is installed in the laser printer 202. As a convenience to the user, the vendor may provide a sheet of label print media to the user for this purpose. Alternatively, the vendor may provide an adhesive envelope into which a label printed on plain paper may be inserted and viewed through the envelope.

Conclusion

Implementation of the recycling shipping label printing system described herein provides a replaceable component vendor with opportunities to communicate with the user as well as the capability to distribute recyclable components to more than one recycling center. The system also provides direction to a printing device user when a replaceable component for a printing device should be recycled.

Although the invention(s) has/have been described in language specific to structural features and/or methodological steps, it is to be understood that the invention(s) defined in the appended claims is/are not necessarily limited to the specific features or steps described. Rather, the specific features and steps are disclosed as preferred forms of implementing the claimed invention(s).

What is claimed is:

1. A method, comprising:

detecting the occurrence of an end-of-life event for a printing device replaceable component, the end-of-life event indicating that the printing device replaceable components requires replacement;

determining a geographic location of the printing device;

determining an appropriate recycling location to which the printing device replaceable component should be sent based on the geographic location of the printing device; and initiating a print job to print a return shipping label for use in shipping the printing device replaceable component to the recycling location.

2. The method as recited in claim 1, wherein:

the printing device replaceable component is a laser printer toner cartridge; and the end-of-life event is a signal that indicates a toner supply in the toner cartridge is depleted.

3. The method as recited in claim 1, wherein the determining an appropriate recycling location further comprises displaying a user prompt to access a recycling network site from where the appropriate recycling location may be determined.

4. The method as recited in claim 1, wherein the determining an appropriate recycling location further comprises accessing a recycling network site from where the appropriate recycling location may be determined from one or more recycling locations.

5. The method as recited in claim 1, wherein the determining a geographic location of the printing device further comprises receiving user input identifying the geographic location.

6. The method as recited in claim 1, further comprising displaying a user prompt for a user to indicate whether the user is ready to replace the printing device replaceable component and print the shipping label, and wherein the print job is only initiated if the user responds to the user prompt in the affirmative.

7. The method as recited in claim 1, further comprising displaying a user prompt to insert special printing media before printing the shipping label, and wherein the print job is only initiated after the special printing media has been inserted.

8. The method as recited in claim 1, wherein the initiating a print job further comprises initiating a print job to print instructions on how to recycle the printing device replaceable component.

9. A printing device, comprising:

a replaceable component;

a detector configured to detect an end-of-life event indicating that the replaceable component requires replacement;

a browser configured to access recycling location information that indicates a recycling location where the replaceable component should be delivered for recycling, the recycling location being dependent upon a geographic location of the printing device; and wherein an appropriate shipping label is printed for use in shipping the replaceable component to the determined recycling location.

10. The printing device as recited in claim 9, wherein the printing device further comprises a laser printer and the printing device replaceable component further comprises a toner cartridge.

11. The printing device as recited in claim 9, wherein the end-of-life event further comprises removal of, the printing device replaceable component and subsequent insertion of a new printing device replaceable component.

12. The printing device as recited in claim 9, further comprising a recycling module configured to receive the geographic location used to determine the recycling location.

13. One or more computer-readable media containing computer-executable instructions that, when executed by a computer, perform the following steps:

detecting the occurrence of an end-of-life event for a print cartridge in a printing device, the end-of-life event indicating that the print cartridge requires replacement;

determining an appropriate recycling location to which the print cartridge should be sent for recycling based on a geographic location of the printing device; and initiating the printing of a shipping label that includes an address for the recycling location.

14. The one or more computer-readable media as recited in claim 13, wherein the print cartridge is a laser printer toner cartridge, and the end-of-life event,is a signal that indicates a toner supply in the toner cartridge is nearing depletion.

15. The one or more computer-readable media as recited in claim 13, further comprising receiving customer information from user input that identifies the geographic location of the printing device.

16. The one or more computer-readable media as recited in claim 13, further comprising displaying a user prompt for a user to indicate whether the user is ready to replace the printing device replaceable component and print the shipping label, and wherein the printing is only initiated if the user responds to the user prompt in the affirmative.

17. A laser printer that embodies the one or more computer-readable media as recited in claim 13.

* * * * *